United States Patent [19]

Lucero

[11] Patent Number: 4,982,464

[45] Date of Patent: Jan. 8, 1991

[54] APPARATUS TO CONVERT A CRIB TO A BED, AND HAVING A STEP

[76] Inventor: Jay M. Lucero, 2453 Ridgewood #4, West Covina, Calif. 91792

[21] Appl. No.: 224,392

[22] Filed: Jul. 26, 1988

Related U.S. Application Data

[63] Continuation-in-part of Ser. No. 71,869, Jul. 9, 1987, Pat. No. 4,763,368.

[51] Int. Cl.[5] ..... A47D 7/01

[52] U.S. Cl. ..... 5/93.2; 5/507

[58] Field of Search ..... 5/2 R, 9 R, 9 B, 93 R, 5/93 B, 100, 424, 425, 507, 508, 512; 182/91

[56] References Cited

U.S. PATENT DOCUMENTS

| | | | |
|---|---|---|---|
| 1,273,354 | 7/1918 | Ganzel | 5/507 X |
| 2,059,240 | 11/1936 | Johnston | 5/100 |
| 2,455,340 | 11/1948 | Newman | 5/93 R X |
| 2,648,850 | 8/1953 | Warren | 5/425 |
| 2,659,902 | 11/1953 | Fitzgerald et al. | 5/507 |
| 2,787,007 | 4/1957 | Erdkamp | 5/2 R |
| 2,941,215 | 6/1960 | Johnson | 5/507 |
| 3,080,577 | 3/1963 | Atkinson | 5/428 |
| 3,627,350 | 12/1971 | Cross | 182/91 X |
| 4,222,136 | 9/1980 | Valentino | 5/507 X |
| 4,359,793 | 11/1982 | Hosono | 5/100 |
| 4,763,368 | 8/1988 | Lucero | 5/93 R |

*Primary Examiner*—Michael F. Trettel

*Attorney, Agent, or Firm*—William W. Haefliger

[57] ABSTRACT

Apparatus is provided to convert a crib to a bed, the crib having walls one of which is removable vertically relative to a supporting vertical guide rod proximate one end corner of the crib, and a second guide rod proximate an opposite end corner of the crib, the crib also having a horizontal pad and a supporting horizontal frame including a frame member extending beneath a side of the pad, the apparatus comprising (a) first arm structure having a first section that extends in supported relation with the first upright rod, and a second section that extends generally horizontally above the level of the side of the pad, (b) the arm structure also having an associated third section extending downwardly from the second section and in spaced relation to the opposite end corner of the crib, the third section having attachment to the frame member, (c) and structure including a step at least partly supported by the second guide rod, the step having an upper surface downwardly offset relative to an upper surface defined by the pad.

10 Claims, 3 Drawing Sheets

FIG. 1.
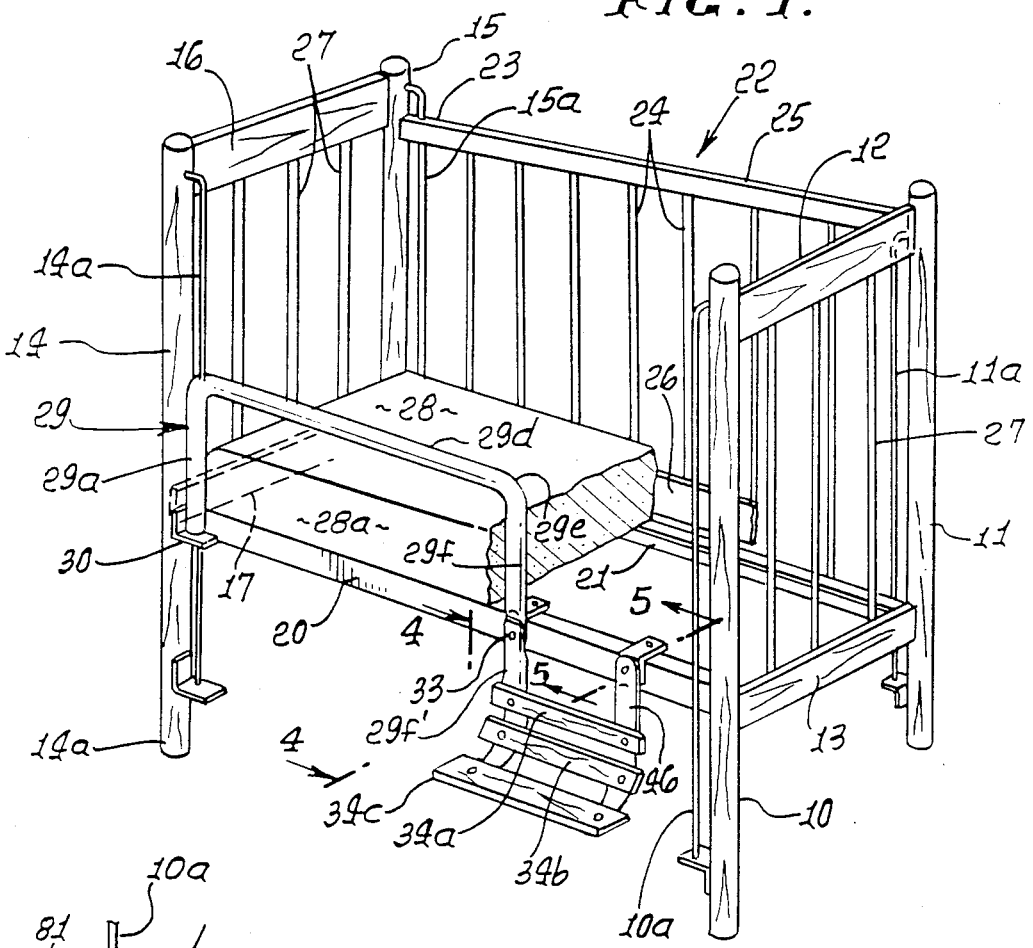
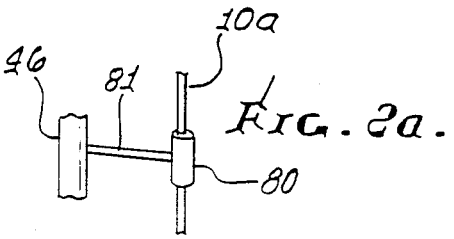
FIG. 2a.
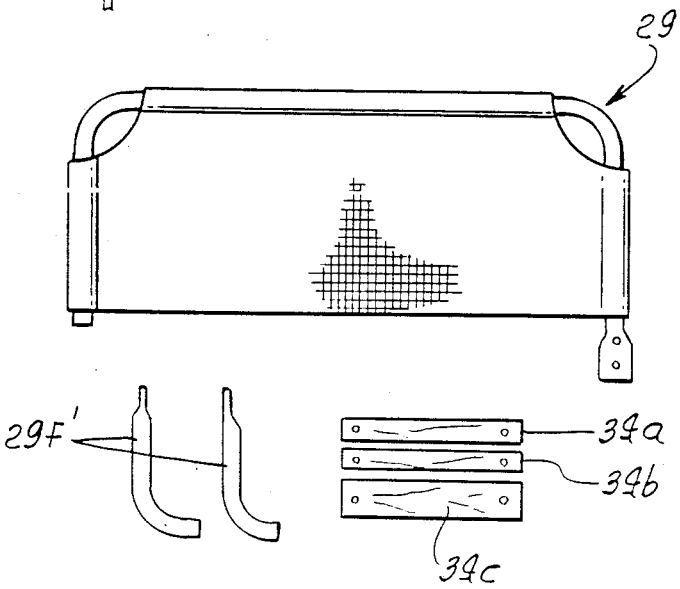
FIG. 2.

APPARATUS TO CONVERT A CRIB TO A BED, AND HAVING A STEP

BACKGROUND OF THE INVENTION

This application is a continuation-in-part of Ser. No. 71,869 filed July 9, 1987, now U.S. Pat. No. 4,763,368.

This invention relates generally to cribs for infants, and more particularly to conversion of such cribs to beds.

It is well known that, as infants grow, their needs for the restraints imposed by cribs are diminished. For example, very small children eventually become dissatisfied with being kept in cribs, and they may seek to climb over crib walls, leading to dangerous falls to the floor. In the past it was then considered necessary to dispose of the crib and to replace it with a small bed, which is expensive and inconvenient. There is need for apparatus to overcome these problems, and to minimize risk of self-impaired harm to the very small child.

SUMMARY OF THE INVENTION

It is a major object of the present invention to provide suitable, effective and low-cost apparatus meeting the above needs. This need is met by the provision of a simple, easy-to-install crib-to-bed conversion kit, or apparatus, which replaces one crib wall or panel with a protective, low-level side rail, and constructed to provide a bed entry-access way or port together with a low level step allowing the small child to climb down off the bed, or enter it, at low safe level and with convenience, whenever desired. Further, the child maintains the compact, familiarity and protective aspects of its "old" crib.

In this regard, a crib to be converted to a bed normally incorporates side walls, one of which is removable vertically relative to a first supporting vertical guide rod proximate one end corner of the crib; and the crib also incorporates a pad or mattress and a supporting, horizontal under-frame including a frame member extending beneath a side of the pad. The crib normally also includes a second vertical guide rod proximate an opposite corner of the crib. In this environment of an existing crib, the invention comprises:

(a) first arm means having a first section that extends in supported relation with the first upright rod, and a second section that extends generally horizontally above the level of said side of the pad, (b) the arm means also having an associated third section extending downwardly from said second section and in spaced relation to said opposite end corner of the crib, the third section having attachment to the frame member, (c) and structure including a step at least partly supported by second vertical rod, the step downwardly offset relative to an upper surface defined by the pad.

Typically, the structure that includes the step provides a vertical through opening closely receiving the second guide rod; and such structure may include a bracket attached to the step and projecting laterally between the step and the second guide rod. Pivoting of the step is allowed by such structure and the second rod.

It is another object of the invention to provide a tubular first arm means the upright first section of which receives the crib first support rod, the latter extending through the side of the tubing proximate a turn defined by the first arm means and located between said first and second sections. This provides for easy assembly of the first section to the existing crib structure in firmly supported relation.

These and other objects and advantages of the invention, as well as the details of an illustrative embodiment, will be more fully understood from the following specification and drawings, in which:

DRAWING DESCRIPTION

FIG. 1 is a perspective view of a converted crib, embodying the invention;

FIG. 2 is an elevation showing components of the crib conversion apparatus or kit; see also FIG. 2*a;*

DETAILED DESCRIPTION

Figure 3:
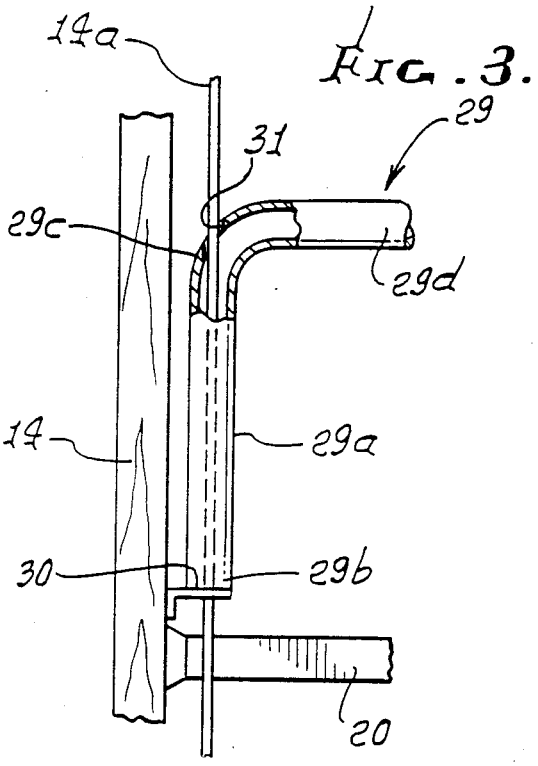
FIG. 3 is an enlarged fragmentary elevation showing a section of an arm and its support.

In FIG. 1, a crib includes right end uprights or legs 10 and 11 interconnected by horizontal and lateral beams 12 and 13, and left end uprights or legs 14 and 15 interconnected by horizontal and lateral beams 16 and 17. Each leg or port has a vertical rod associated therewith, as seen at 10*a*, 11*a*, 14*a* and 15*a*. Lower longitudinal front frame member 20 connects the left and right legs 14 and 10; and a similar rear frame member 21 connects the left and right legs 15 and 11. Normally, crib front and rear panel units are removably connected to the crib structure as via the rods; for example, rear vertical panel unit 22 has end sleeves 23 that fit over rods 15*a* and ll*a*, and a front vertical panel unit (not shown) has similar end sleeves that fit on rods 14*a* and 10*a*. When the rods are disconnected from the legs, the front and rear panel units are removed. Vertical retention bars 24 are suitably carried by the horizontally elongated members 25 and 26 of the front and rear panels, and similar bars 27 are carried by the members 12 and 13, and by the members 16 and 17.

Normally, the crib also carries a horizontal pad such as a mattress indicated at 28, the frame member 20 extending horizontally herewith the front edge 28*a* of the pad.

In accordance with the invention, a first arm means, such as an arm 29, is provided to replace the front panel (like panel 22) which is removed. The bar 29 has a front upright section 29*a* that extends in supported relation with the rod 14*a*. The arm is typically tubular, and FIG. 3 shows the first section 29*a* as fitted over the lower extent of rod 14*a* and as having a lower end terminus 29*b* seated on a bracket 30 that is attached to leg 14, above the foot 14*a* of that leg.

Figure 5:
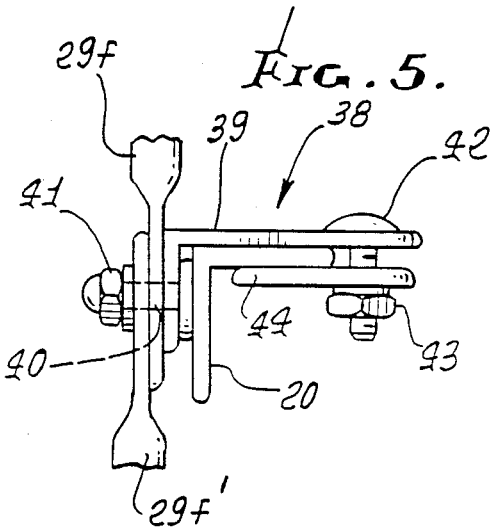
FIG. 5 is an enlarged fragmentary elevational view taken on lines 5—5 of FIG. 1.
Figure 4:
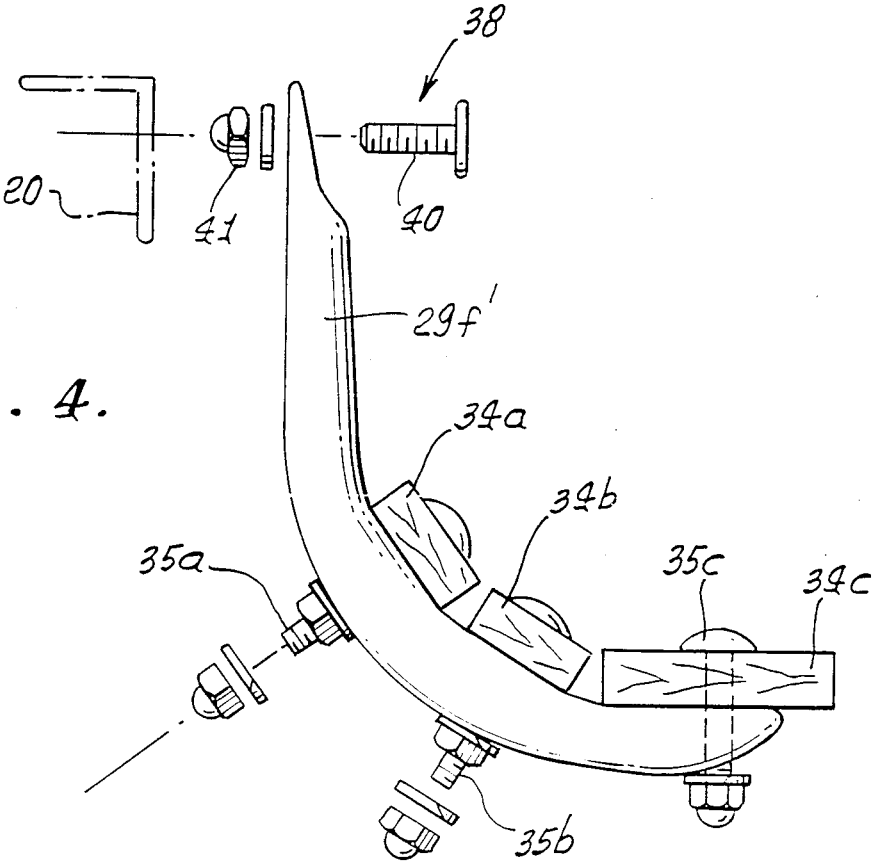
FIG. 4 is an enlarged fragmentary elevational view taken on lines 4—4 of FIG. 1.

The arm 29 is curved at 29*c*, and a hole 31 drilled in the side of the arm passes the rod. The arm also includes a second section 29*d* that extends generally horizontally above the level of the front side 28*a* of the pad, for more than half the length of the crib, and toward leg 10. The arm 29 also has a third section 29*f* that extends downwardly from a curved part 29e of the arm integral with 29d, as shown. Section 29f is spaced from the opposite end of the crib defined by legs 10 and 11, the section 29f having attachment to the frame member 20 at location 33. The third section projects downwardly below the level of member 20 and curves forwardly, as also indicated in FIG. 4. A step is at least partly supported by the lower extent 29f' of section 29f, the step for example including the three horizontally and longitudinally extending plates 34a, 34b and 34c, as shown. As seen in FIG. 4, those plates may be attached to the forwardly curved extent 29f' by carriage bolts and nuts 35a–c and 36a–c. Such gradual curvature of the step, as afforded by the plates, prevents injury to a toddler descending via the outlet afforded between the arm 29 and the leg 10. The upper end of the curved bar extent 29f' is attached to the frame member 20 as by bracket assembly 38. See also FIG. 5, showing L-shaped clip angle 39 attached to 29f and 29f' as by bolt and nut 40 and 41, and attached to the frame member 20 as by bolt and nut 42 and 43, and clip 44.

A second arm means, such as arm 46, is provided to have attachment to the frame member 20 and to extend downwardly in spaced relation to the arm extent 29f', and in similarly curved relation, to support the opposite ends of the step plates (see FIG. 4). Thus, arm 46 has the same construction as lower curved extent 29f' of arm 29, and has similar attachment to the frame member 20, as is shown in FIG. 5.

The step plates 34a to 34c can be made one single plate, such as molded plastic, and with upward concavity, and the forwardmost edge of the step plate can extend downwardly, close to floor level Also, a similar apparatus or kit as disclosed herein can be installed at the opposite side of the crib after removal of panel 22, thereby providing two step-entries to the bed.

Finally, the step could be swing-attached to the rod 10a, instead of to frame 20. See FIG. 2a showing step member 46 pivoted to rod 10a, by sleeve 80 and member 81.

Figure 6:
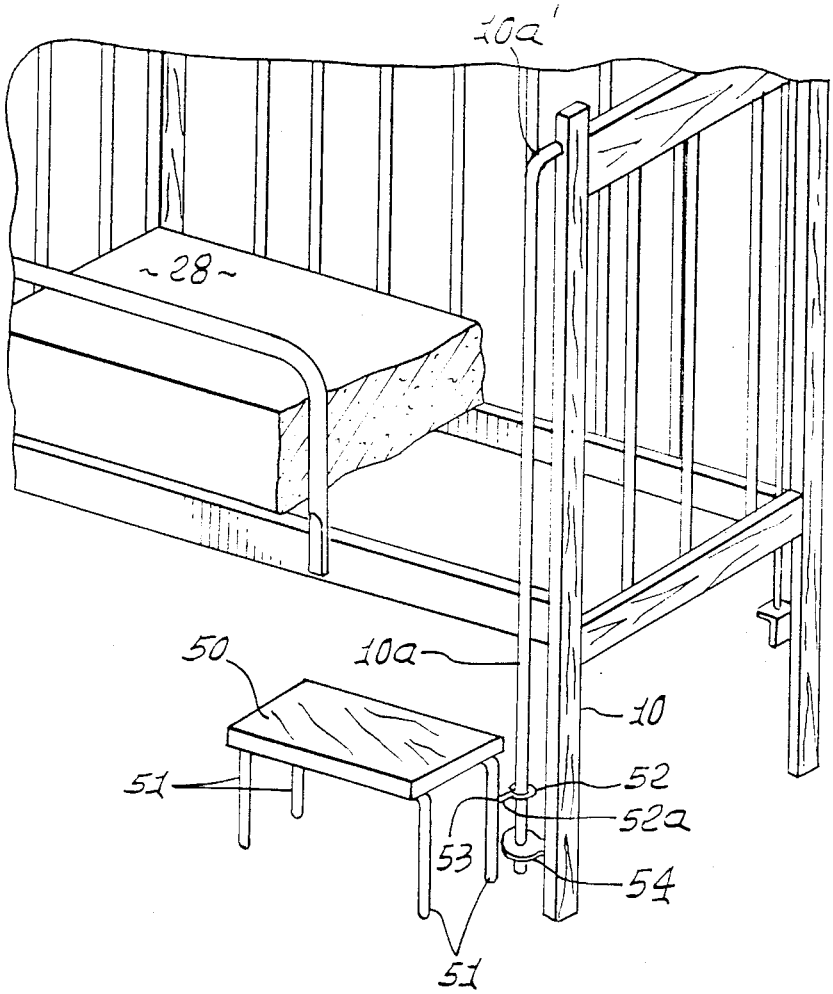
FIG. 6 is a perspective view showing a step structure connection to a second vertical rod.

FIG. 6 is like FIG. 1, except for the support of the step. The step 50 has legs 51, and is located at the side of the modified crib, and below the level of the pad or mattress 28. The step structure is effectively connected to the vertical rod 10a to allow pivoting of the step, for floor cleaning purposes (for example). Further, the connection desirably or may prevent over-turning of the step while a child climbs into or out of the crib.

In particular, FIG. 6 shows a bracket connection of the step to the rod 10a; thus, an eye-bolt bracket 52 has a stem 52a rigidly connected at 53 to the leg 51, and its loop or eye 52b closely passes the second rod 10a that is otherwise connected to the post 10 (as via lower bracket 54 receiving the rod and connected to the post, and via upper turned end 10a' of the rod).

Figure 8:
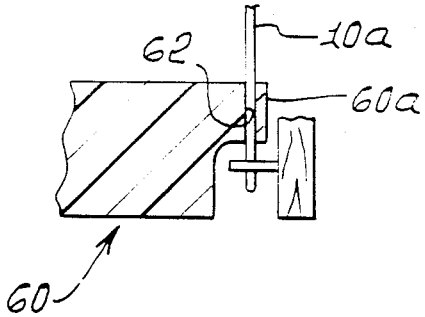
FIG. 8 is a vertical section showing a modified connection of step structure to the second rod.
Figure 7:
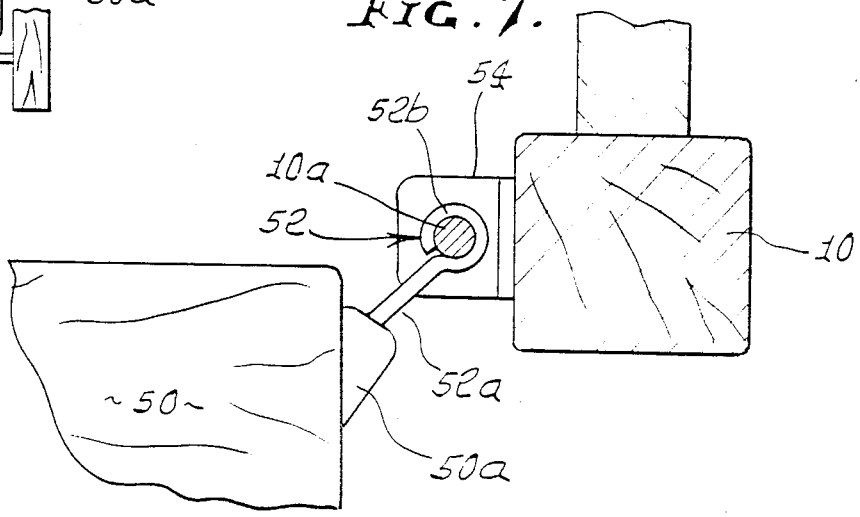
FIG. 7 is a plan view, in section, showing the connection of the step structure of FIG. 6 to the second rod.

In FIG. 7, the same eye bolt bracket 52 has its stem 52a rigidly connected to a corner portion 50a of the step, instead of leg 51. In FIG. 8, the modified step 60 has a body (which may for example consist of molded and air expanded plastic material) that defines at one corner or side 60a a vertical through opening 62 that receives or passes the rod 10a, eliminating need for the bracket. These forms allow pivoting of the step about the vertical axis of the rod 10a. If desired, the step may pivotably connect to the post 10, as if rod 10a is removed.

I claim:

1. Apparatus to convert a crib to a bed, the crib having walls one of which is removable vertically relative to a first supporting upright guide rod proximate one end corner of the crib, and relative to a second supporting upright guide rod proximate an opposite end corner of the crib, the crib also having a horizontal pad and a supporting horizontal frame including a frame member extending beneath a side of the pad, said apparatus comprising (a) first arm means having a first section that extends in supported relation with said first upright rod, and a second section that extends generally horizontally above the level of said side of the pad, (b) said arm means also having an associated third section extending downwardly from said second section and in spaced relation to said opposite end corner of the crib, said third section having attachment to said frame member, (c) and structure including a step at least partly supported by said second guide rod, the step having an upper surface downwardly offset relative to an upper surface defined by the pad, (d) the first section of the arm means having guided engagement with said first guide rod, the first guide rod also extending through an opening associated with a side of the said arm means first section proximate a turn defined by the first arm means located between said first and second sections.

2. The apparatus of claim 1 wherein said structure provides a vertical through opening closely receiving said second vertical guide rod.

3. The apparatus of claim 2, wherein said structure includes a bracket effectively attached to the step and projecting laterally, the bracket forming said vertical opening and allowing pivoting of the step relative to the second guide rod.

4. The apparatus of claim 1 wherein said first arm means comprises metallic tubing.

5. The apparatus of claim 1 wherein said first, second and third sections defined by the first arm means comprise a single length of metallic tubing.

6. Apparatus to convert a crib to a bed, the crib having walls one of which is removable vertically relative to a first supporting upright guide rod proximate one end corner of the crib, and relative to a second supporting upright guide rod proximate an opposite end corner of the crib, the crib also having a horizontal pad and a supporting horizontal frame including a frame member extending beneath a side of the pad, said apparatus comprising (a) first arm means having a first section that extends in supported relation with said first upright rod, and a second section that extends generally horizontally above the level of said side of the pad, (b) said arm means also having an associated third section extending downwardly from said second section and in spaced relation to said opposite end corner of the crib, said third section having attachment to said frame member, (c) and structure including a step at least partly supported by said second guide rod, the step having an upper surface downwardly offset relative to an upper surface defined by the pad, (d) said first arm means comprising metallic tubing, said first section of the tubing receiving said first rod therein, said first rod extending through the side of the tubing proximate a turn defined by the first arm means and located between said first and second sections.

7. In a crib, the combination comprising:

(a) a frame, and two end walls and one side wall connected to the frame, and two vertical supports respectively proximate or at corners defined by the frame, (b) the mattress having an upper surface, (c) a protective side rail extending generally parallel to and above one side edge of the mattress opposite said side wall, the rail having a vertical section and associated guide openings closely vertically receiving one of the vertical supports, for operatively holding the rail sidewardly to said one vertical support, (d) and step structure connected to the other vertical support, and located below the level of said mattress upper surface.

8. The combination of claim 7 wherein the step structure includes a body forming a vertical through opening receiving the other vertical support.

9. The combination of claim 7 wherein the step structure includes a connector projecting laterally and forming a vertical through opening receiving the other vertical support.

10. Apparatus to convert a crib to a bed, and in combination with the crib, the crib having walls one of which is removable vertically relative to a first supporting vertical guide rod proximate one end corner of the crib, and relative to a second supporting vertical guide rod proximate another end corner of the crib, the crib also having a horizontal pad and a supporting horizontal frame including a frame member extending beneath a side of the pad, said apparatus comprising (a) first arm means in the form of a rigid arm having a first section that extends in supported relation with said upright rod, said one section having associated vertically spaced openings that guidedly pass said upright rod, and a second section that extends generally horizontally above the level of said side of the pad, (b) said arm means also having an associated third section extending downwardly from said second section and in spaced relation to an opposite end corner of the crib, said third section connected to said frame member, (c) and a step at least partly supported by said second guide rod, the step downwardly offset relative to an upper surface defined by the pad, (d) said first, second and third sections extending as a generally continuous length of said rigid arm, (e) said first section of the arm retained by said first rod, the first rod extending adjacent the arm proximate a turn defined by the first arm means.

* * * * *